US007551104B2

(12) United States Patent
Meng

(10) Patent No.: US 7,551,104 B2
(45) Date of Patent: Jun. 23, 2009

(54) TRAFFIC CONTROL METHOD AND APPARATUS

(76) Inventor: Welping Meng, 133-34 41st Ave. #2A, Flushing, NY (US) 11355

( * ) Notice: Subject to any disclaimer, the term of this patent is extended or adjusted under 35 U.S.C. 154(b) by 0 days.

(21) Appl. No.: 10/486,952

(22) PCT Filed: Aug. 16, 2001

(86) PCT No.: PCT/CN01/01228

§ 371 (c)(1),
(2), (4) Date: Feb. 13, 2004

(87) PCT Pub. No.: WO03/017228

PCT Pub. Date: Feb. 27, 2003

(65) Prior Publication Data

US 2004/0204819 A1 Oct. 14, 2004

(51) Int. Cl.
*G08G 1/095* (2006.01)

(52) U.S. Cl. ..... 340/907; 340/906; 340/924; 340/925; 701/117; 701/118

(58) Field of Classification Search ..... 340/906, 340/907, 909, 916, 917, 924, 925; 701/117, 701/118

See application file for complete search history.

(56) References Cited

U.S. PATENT DOCUMENTS 2,705,789 A * 4/1955 Barker ..... 340/918
6,317,058 B1 * 11/2001 Lemelson et al. ..... 340/910

* cited by examiner

*Primary Examiner*—Daryl C Pope

(57) ABSTRACT

A method called as a time-differential-ratio method and its apparatus used for intersection traffic control that differentially operates on the traffic so as to change pass-permit direction with traffic status in time is disclosed. The method includes the steps of starting, timing, vehicle-requesting, extra-moving, ratio-moving, and recycling. Unlike a common control method called as macro-estimate control method that forces changeable traffic to follow a given period and direction turn order to pass, which causes lots of stops and wait, a differential operations on the traffic are integrated with a common ratio control method and walker signals. It shows the operating features and the effective characteristic of both micro-time control and macro ratio control, which lets a vehicle arriving first pass first conditionally, is good for real-time arbitrary traffic pattern control, and leads to great reduction of stops and wait. The apparatus needed for the method includes sensing/detecting apparatuses and processing apparatus.

19 Claims, 4 Drawing Sheets

The Architecture Of An Apparatus-2 For 4 Directions

A FlowChart of The present Method-2 Invention

* 3.b if the state = Extra-Move and
* 3.b.2 if there are vehicle request in a non-Extra-Direction and the next Extra-Direction = null,
the next Extra-Direction = the non-Extra-Direction, run 3.b.4
* 3.b.3 if there are new vehicle requests in Extra-Direction, A Frame of A Method-2-Based 8051 Program Embodiment
FIG. 2 Embodiment 2

FIG.3 The Architecture Of An Apparatus-2 For 4 Directions

TRAFFIC CONTROL METHOD AND APPARATUS

CROSS REFERENCE TO RELATED APPLICATIONS (Not Applicable)

FEDERALLY SPONSORED RESEARCH/DEVELOPMENT (Not Applicable)

BACKGROUND OF THE INVENTION

Technical Field and Prior Art

The present invention relates generally to a method and its apparatus for controlling intersection traffic, particularly to a time-differential-ratio method and its apparatus for controlling vehicles and/or walkers to use an intersection.

The most common traffic control apparatus for an intersection consists of a signal controller and a signal colored displayer: Red-Stop, Yellow-Slow, Green-Move, and Left, Right, and Walk signals. There are two signal control methods widely used with the apparatus: ratio-method and green-wave method.

The ratio-method is: setting up a permit time for every direction according to some ratio, for example, a ratio of north-south over east-west in traffic volumes; the only one pass-permit is to be alternated among directions in appropriate order when a pass-permit direction runs out its permit time. This order is called as ratio-method permit direction alternation order. The direction whose time is being used is called as a ratio-method direction. Note: hereinafter, the only pass-permit is simply called as permit.

The green-wave method is: based on the ratio-method, setting up a direction as a green-wave direction in which the start time of the Green-Move of a downstream intersection in the green-wave direction is delayed by some quantity compared to its upstream, for example, the quantity to take a vehicle from its upstream one to the downstream. The control performance of a road net using the green-wave method is better than the ratio-method. The green-wave-method can control multiple, parallel, opposite directions traffic in different roads through its control area.

Both methods belong to a macro-estimate control method. A road-net using the ratio-method or the green-wave-method shows integral in operation, macro in time, slow and hard in response to changeable traffic. The leading disadvantage of them is that they are unable to grant a permit to a vehicle arriving first but always force vehicles arriving stochastically to follow their permit period and direction alternation order. Furthermore they always force the whole controlled road net area with different local traffic characteristics to follow the period and the alternation order, which causes lots of stops and waiting time.

Many micro-time control methods are proposed and being tested in order to overcome this disadvantage of the current macro-estimate techniques. According to their limited disclosure, none of these methods are practical or effective. The common disadvantages of them are: 1) they produce technique-inherent traffic jam due to their intersection's being neither capable of coordinating nor easy to coordinate with their adjacent intersection; 2) communication function or central control, by which one could solve the traffic jam, are harder to fulfill for changeable traffic or to extend; 3) they have a smaller changeable time ratio with bigger response time for tracing traffic patterns; 4) they have narrower scope for traffic pattern recognition; 5) they have limited practical requirements based on mathematical method and limit for its optimization; 6) the trouble and impossibility of proper integrity with walk signals, and so on.

BRIEF SUMMARY OF THE INVENTION

It is an object of the present invention to provide a method and its apparatus for traffic control in order to avoid the previously said shortcomings of all the current, tested, and proposed techniques.

More particularly, it is an object of the present invention to provide a method and its apparatus that is both able to dynamically dispatch permit with mini-adjustable permit time directly based on oncoming vehicles' requests in at least one controlled direction and able to integrate these dynamic-mini-operations with common ratio-method. So, the present invention has the operating features and the effective characteristic of both micro-time control and macro ratio control, by which a vehicle arriving first may be granted a permit first conditionally. Riemann Sum is here cited as and applied for theoretical foundation for this object. These mini-adjustable permit time can be optimized on Riemann Sum theory. In order to meet typical traffic feature demands, the present invention includes two main correlated methods and their apparatus: a method and apparatus for only controlling vehicles to use an intersection, named as method-1, the other method and apparatus including method-1 for both controlling vehicles and walkers to use an intersection.

In keeping with the object, the features of the present invention reside in:

The present invention for controlling vehicles to use an intersection includes a method of using an intelligent traffic control apparatus, various sensing/detecting apparatus, and appropriate control logic for controlling the granting of a permit for a vehicle to use an intersection with mini-adjustable permit time. The method includes acts of: (a) obtaining oncoming-vehicles' motion parameters from traffic information units in a direction of an intersection, (b) transmitting the directional vehicle requests to the at least one intelligent control apparatus, (c) determining whether or not to change a current permit direction into another permit direction based on a ratio-extra-method logic directly using the received directional vehicle requests as input parameters, wherein the ratio-extra-method occupies appropriate time of a ratio-method, (d) letting oncoming vehicles or their operators in every direction know, by appropriate means, whether or not they are granted permits to use the intersection. One of the appropriate control logic is ratio-extra-method that includes acts: a direction may safely be granted a permit if in this direction there are vehicles' requests and in current permit directions there is no vehicle's request, wherein the permit is bound to appropriate time that comes from occupying mentioned ratio-method permit time and such a permit is called as an extra-method permit.

The present invention for controlling vehicles to use an intersection uses a ratio-extra-method logic for controlling traffic comprising the acts of:

(a) determining whether or not to change a current ratio-method permit direction into an extra-method permit direction based on an appropriate priority order with directly referring to the received directional vehicle requests, wherein the extra-method is one of the appropriate priority orders granting permit to a direction that are called as an extra-method permit direction, inserted beyond direction alternation order of a ratio-method, and occupies appropriate time of a ratio-method, (b) changing and/or extending the current extra-method permit based on an appropriate priority order with directly referring to the received directional vehicle requests when the current extra-method permit time runs out, (c) changing the current ratio-method permitted direction into the next ratio-method permit direction in a ratio-method permit direction alternation order when the current ratio-method permit time runs out.

The present invention for controlling vehicles to use an intersection includes appropriate acts in the aforementioned control logic that can extend said extra-method permit. The appropriate logic includes acts: a direction may be granted an extra-method permit if there are vehicles' requests in a direction that is not a ratio-method direction and there are no vehicle's request in a ratio-method directions when current extra-method permit time runs out, wherein the extra-method permit is bound to appropriate time that comes from occupying said ratio-method permit time.

The present invention for controlling vehicles to use an intersection includes said appropriate time in the aforementioned control logic. Said appropriate time should be big enough for a vehicle and small enough for only one vehicle to pass the intersection from the position of said appropriate distance of said various sensing/detecting apparatus at the limit speed at a direction, usually smaller than 10 seconds.

The present invention for controlling vehicles and walkers to use an intersection includes a method of using an intelligent traffic control apparatus, said various sensing/detecting apparatus for oncoming vehicles' acquirement, and various sensing/detecting apparatus for cross-waiting walkers' acquirement. The method includes acts of: (a) obtaining oncoming-vehicles' motion-parameters in at least one direction of an intersection as directional vehicle requests from the traffic information units, (b) obtaining cross-waiting walkers requests in at least one direction of an intersection as directional walker requests from the walker information units, (c) transmitting the directional vehicle requests to the at least one intelligent control apparatus, (d) transmitting the directional walker requests to the at least one intelligent control apparatus, (e) determining whether or not to grant a walker request a walk permit with appropriate time and whether or not to change current permit directions into another permit directions based on a ratio-extra-method logic with directly referring to the received directional vehicle requests and the received directional walker requests, wherein the ratio-extra-method occupies appropriate time of a ratio-method, (f) letting oncoming vehicles or their operators, and walkers in every direction know, by appropriate means, whether or not they are granted permits to use the intersection.

The present invention for controlling vehicles and walkers to use an intersection includes appropriate logic in the aforementioned control logic that can grant a walk permit to a waler's request. The appropriate logic includes acts: 1) a ratio-method direction without a permit may be granted a walk permit with appropriate time if there are walkers' requests in a non ratio-method direction when current extra-method permit time runs out and the rest time of the ratio-method direction is sufficient for the appropriate time; 2) a ratio-method direction with a permit may be granted a walk permit with appropriate time for walkers if there are walkers' requests in a non ratio-method direction and the rest time of that ratio-method direction is sufficient for the appropriate time.

The present invention for controlling vehicles and walkers to use an intersection uses a ratio-extra-method logic comprising the acts of:

(a) determining whether or not to grant a walker request a walk permit with appropriate time and whether or not to change current ratio-method permit directions into extra-method permit directions based on an appropriate priority order with directly referring to the received directional vehicle requests and the received directional walker requests, wherein the extra-method is one of the appropriate priority orders granting permit to a direction that is called as an extra-method permit direction, inserted beyond direction alternation order of a ratio-method, and occupies appropriate time of a ratio-method, (b) changing and/or extending the current extra-method permit based on an appropriate priority order with directly referring to the received directional vehicle requests and the received directional walker requests when the current extra-method permit time runs out, (c) changing the current ratio-method permitted direction into the next ratio-method permit directions in a ratio-method permit direction alternation order when the current ratio-method permit time runs out.

(d) changing and/or extending the current walk permit based on an appropriate priority order with directly referring to the received directional vehicle requests and the received directional walker requests when the current walk permit time runs out.

The present invention for controlling vehicles and walkers to use an intersection includes a system comprising:

(a) intelligent control apparatus that may be local, distributed, centered, or remote; and that each have: (i) a processor and memory configured to monitor the requests from vehicle request units and walker request units in the vicinity around an intersection; (ii) a receiver that receives and analyzes communication signals; (iii) a transmitter that generates and transmits signals;

(b) vehicle request units that each have: (i) a transmitter that generates and transmits signals to the intelligent control apparatus;

(c) walker request units that each have: (i) a transmitter that generates and transmits signals to the intelligent control apparatus;

(d) vehicle control signal displayers that each have: (i) displayers that show the control signals, permit, to vehicles from the intelligent control apparatus;

(e) walker control signal displayers that each have: (i) displayers that show the control signals, permit, to walkers from the intelligent control apparatus;

(f) wherein: (i) vehicle request units transmits directional vehicle requests to the intelligent control apparatus; (ii) walker request units also transmits directional walker requests to the intelligent control apparatus; (iii) the intelligent control apparatus receive and process the requests from vehicles request units and walker request units; (iv) the intelligent control apparatus transmits the vehicle control decision to the vehicle control signal displayers; (v) the intelligent control apparatus transmits the walker control decision to the walker control signal displayers.

The present invention for controlling vehicles to use an intersection includes said various sensing/detecting apparatus that acquire the existence of oncoming vehicles in appropriate distance from an intersection and transmit the acquired existences of oncoming vehicles as directional vehicles' requests for using the intersection to an intelligent traffic control apparatus. The various sensing/detecting apparatus can be any apparatus with any changer or converters for energy-to-electricity: Piezo transducers of sound, receivers, transducers, radars, cameras, even button-switches, for any kind of electromagnetic waves such as light, infrared. The appropriate distance mentioned is determined by the limit speed in a direction of an intersection and braking distance of a vehicle running at the limit speed, should be big enough for a vehicle to make a brake and small enough for a vehicle to stop access just in front of the intersection, usually smaller than 50 meters.

The present invention for controlling vehicles and walkers to use an intersection includes acts in the aforementioned control logic that can extend said extra-method permit. The appropriate logic includes acts: a direction may be granted an extra-method permit if there is traffic in the direction that is not a ratio-method direction and there are neither vehicle's request in ratio-method directions nor walkers' requests in all non ratio-method directions when current extra-method permit time runs out, wherein the extra-method permit is bound to appropriate time that comes from occupying said ratio-method permit time.

The present invention for controlling vehicles and walkers to use an intersection uses said appropriate time for vehicles in the aforementioned control logic. Said appropriate time should be big enough for a vehicle and small enough for only one vehicle to pass the intersection from the position of said appropriate distance of said various sensing/detecting apparatus at half of the limit speed at a direction, usually smaller than 10 seconds.

The present invention for controlling vehicles and walkers to use an intersection includes said various sensing/detecting apparatus that acquire the existence of oncoming vehicles in appropriate distance from an intersection and transmit the acquired existences of oncoming vehicles as directional vehicles' requests for using the intersection to an intelligent traffic control apparatus. The various sensing/detecting apparatus can be any apparatus with any changer or converters for energy-to-electricity: Piezo transducers of sound, receivers, transducers, radars, cameras, even button-switches, for any kind of electromagnetic waves such as light, infrared. The appropriate distance mentioned is determined by the limit speed in a direction of an intersection and braking distance of a vehicle running at the limit speed, should be big enough for a vehicle to make a brake and small enough for a vehicle to stop access just in front of the intersection, usually smaller than 50 meters.

The present invention for controlling vehicles to use an intersection uses appropriate data-computing-permit-updating frequency in the aforementioned method. Said frequency of sensing/detecting vehicles' requests, executing the control logic, and updating permits should be equal to or higher than once every 6 seconds, that's, the period corresponding to the frequency should be equal to or smaller than 6 seconds.

The present invention for controlling vehicles and walkers to use an intersection uses appropriate data-computing-and-permit-updating frequency in the aforementioned method. Said frequency of sensing/detecting vehicles' requests, executing the control logic, and updating permits should be equal to or higher than once every 6 seconds, that's, the period corresponding to the frequency should be equal to or smaller than 6 seconds.

The present invention for controlling vehicles and walkers to use an intersection includes appropriate time with a walk permit in the aforementioned control logic. The appropriate time for walk permit may be extended based on appropriate logic with referring to walkers' requests.

The present invention for controlling vehicles and walkers to use an intersection includes appropriate time with a walk permit in the aforementioned control logic. The appropriate time for walk permit should be big enough for walkers and small enough for only one group of walkers to pass the intersection from an appropriate walker-wait-line, usually equal to or bigger than roadwidth in the direction divided by walker speed.

The present invention for controlling vehicles and walkers to use an intersection includes said appropriate walker-wait-line that is a line on a road curb where people can reach a walk-request-button directly and be sensed/detected by walk information units.

The present invention for controlling vehicles and walkers to use an intersection includes aforementioned system wherein the vicinity around an intersection of (a) is appropriate distance within which from an intersection each vehicle request unit of act (a) is able to recognize whether or not an oncoming vehicle exists, wherein the appropriate distance is determined by the limit speed in a direction of an intersection and the braking distance of a vehicle running at the limit speed, is big enough for a vehicle to make a brake and small enough for a vehicle to stop access just in front of the intersection, usually required smaller than 50 meters.

The present invention for controlling vehicles to use an intersection includes appropriate logic in the aforementioned control logic that can change a permit from extra-method to ratio-method. The appropriate logic includes acts: a ratio-method direction may be granted a permit if there is traffic in this direction when current extra-method permit time runs out.

The present invention for controlling vehicles and walkers to use an intersection includes appropriate logic in the aforementioned control logic that can change a permit from extra-method to ratio-method. The appropriate logic includes acts: a ratio-method direction may be granted a permit if there are either vehicle's requests in this direction or walkers' requests in a non ratio-method direction when current extra-method permit time runs out.

The advantages of the present invention are below: I. Independent but cooperative run: the running of one intersection system of the present invention only need collecting and analyzing local micro-traffic status of the intersection that the system is controlling and relates neither to the information from other intersections nor any other control apparatus; despite this independency the adjacent intersections using the present invention can still cooperate easily with one another.

II. Reserved rights for walkers: due to maintaining the operating features of a ratio-method with Walker that signals dynamically, by setting up permit-priority order of walker and Extra-Move, the rights for walker are reserved basically like the ones under regular ratio-method.

III. Real time large scale changeable control ratio $(0,\infty)$ with mini-response-time for tracing intersection traffic arrival distribution: dynamical micro time permit dispatching operations with the change of traffic distribution among controlled directions, depicted previously, minimizes response time of local traffic, maximizes the time-ratio, from almost zero ratio to infinite tracing the traffic load, and leads the best control performance for an intersection based on the theory of Riemann Sum. Irregular changes and distribution are recorded for traffic load characteristics at intersections. The extra-method mini permit time given previously is viewed as a time-difference. The total throughput over a period is a Riemann Sum or a discrete definite integral of instant throughput in all controlled directions over time, whereas total arrivals over a period is a Riemann Sum of instant arrival rates in all controlled directions over time. Naturally the less the time-difference, the more flexible the present invention operates, then the more closing or similar to the previously said arrival curve the throughput curve is, and the better performance it means. But too small a time difference will practically cause vehicle collisions. With the tradeoff of theoretically performance and applicability, an acceptable extreme for the best solution may be determined.

IV. Automatically real-time traffic flow pattern recognition: the road net system using the present invention as basic control units for their intersections shows the capability of easily-coordinating, easily-extending, simultaneously multiple-direction green-wave-pass, multiple-sub-areas green-wave-pass, multiple-polylines green-wave-pass, matching with any traffic flow pattern. It also shows the capability of timely, automatically and smoothly changing the green-wave-pass directions, sub-areas and their borders, polylines and their borders with corresponding traffic demands: real-time matching with arbitrary traffic flow pattern under the load lower than near-saturated traffic load. These reduce and postpone traffic jam. The road net under near-saturated traffic loads or greater follows ratio-method automatically, and can further be improved and optimized under those loads by using road net systematic traffic engineering controls.

V. The best road net system for modern traffic control derived on the Riemann Sum theory: the road net system given in IV just meets modern traffic changeable demands for multiple-direction flow, multiple-sub-area flow, and multiple-polyline flow in an intersection-arbitrarily-distributed road-net mixing plane-crossings with solid-crossings. Whereas the road net is an area-difference time-difference ratio control system, a sub-area is regarded as an area-difference. The less the area-difference, the more closing or similar to an area-traffic distribution curve surface the instant area-throughput distribution curve surface is, then the better performance it means. The practical extreme for an area-difference just is an intersection using the present invention that has already optimized the performance.

BRIEF DESCRIPTION OF THE DRAWINGS AND TABLES

Figure 1:
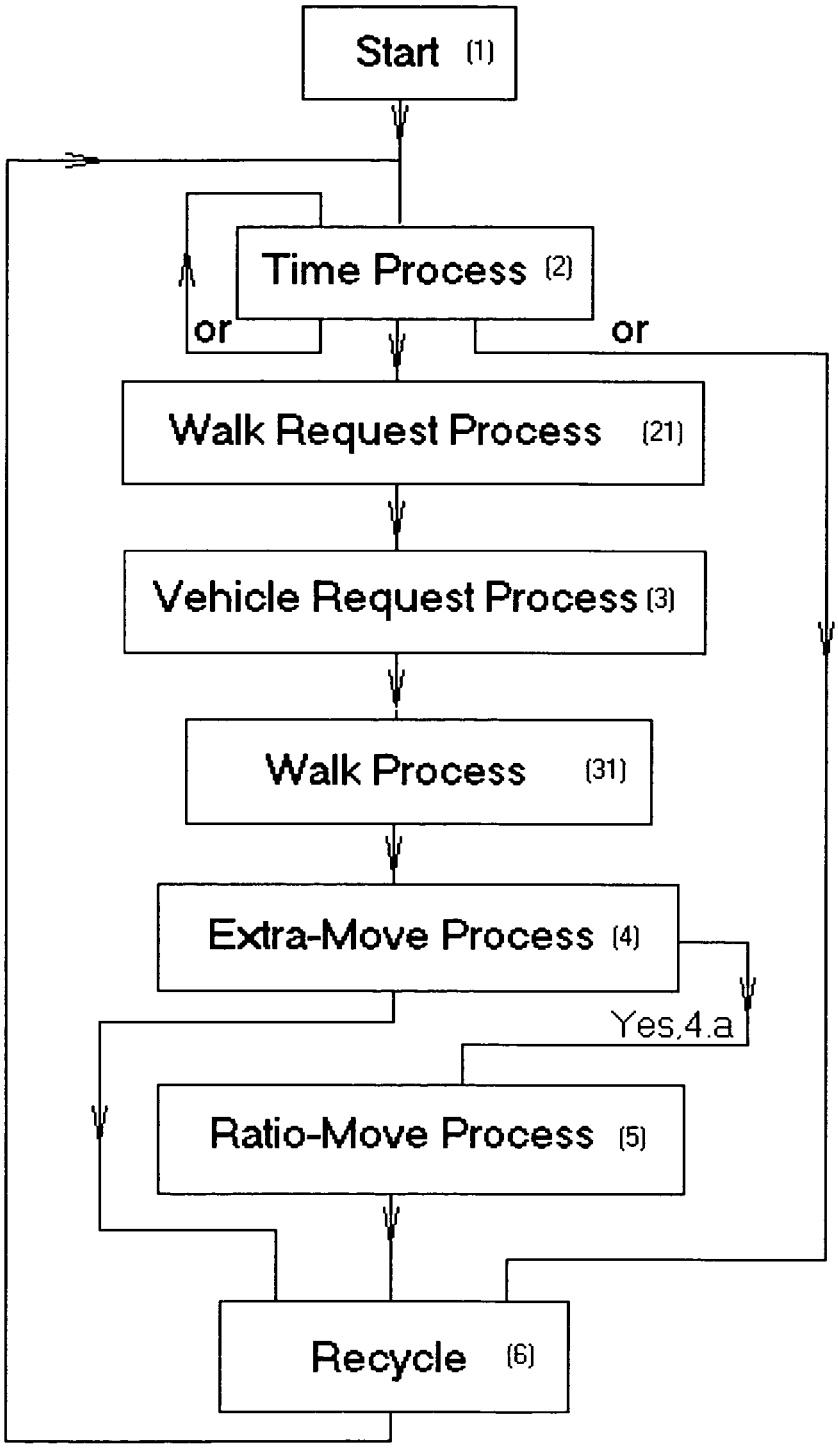
FIG. 1 is a flowchart of method-2, the method for controlling vehicles and walkers to use an intersection.

TAB.1 lists the names, denotions, measurement unit, evaluations, and notes of all parameters used in embodiments.

TAB.2 is a true value table of a Ratio-State Permit Change Logic with Walk within Permit Time.

TAB.3 is a true value table of an Extra-State Permit Change Logic with Walk When Permit Time=0

TAB.4 is a true value table of a Ratio-State Permit Change Logic with Walk When Permit Time=0.

LIST OF REFERENCE NUMERAL UTILIZED IN THE DRAWING

Figure 4:
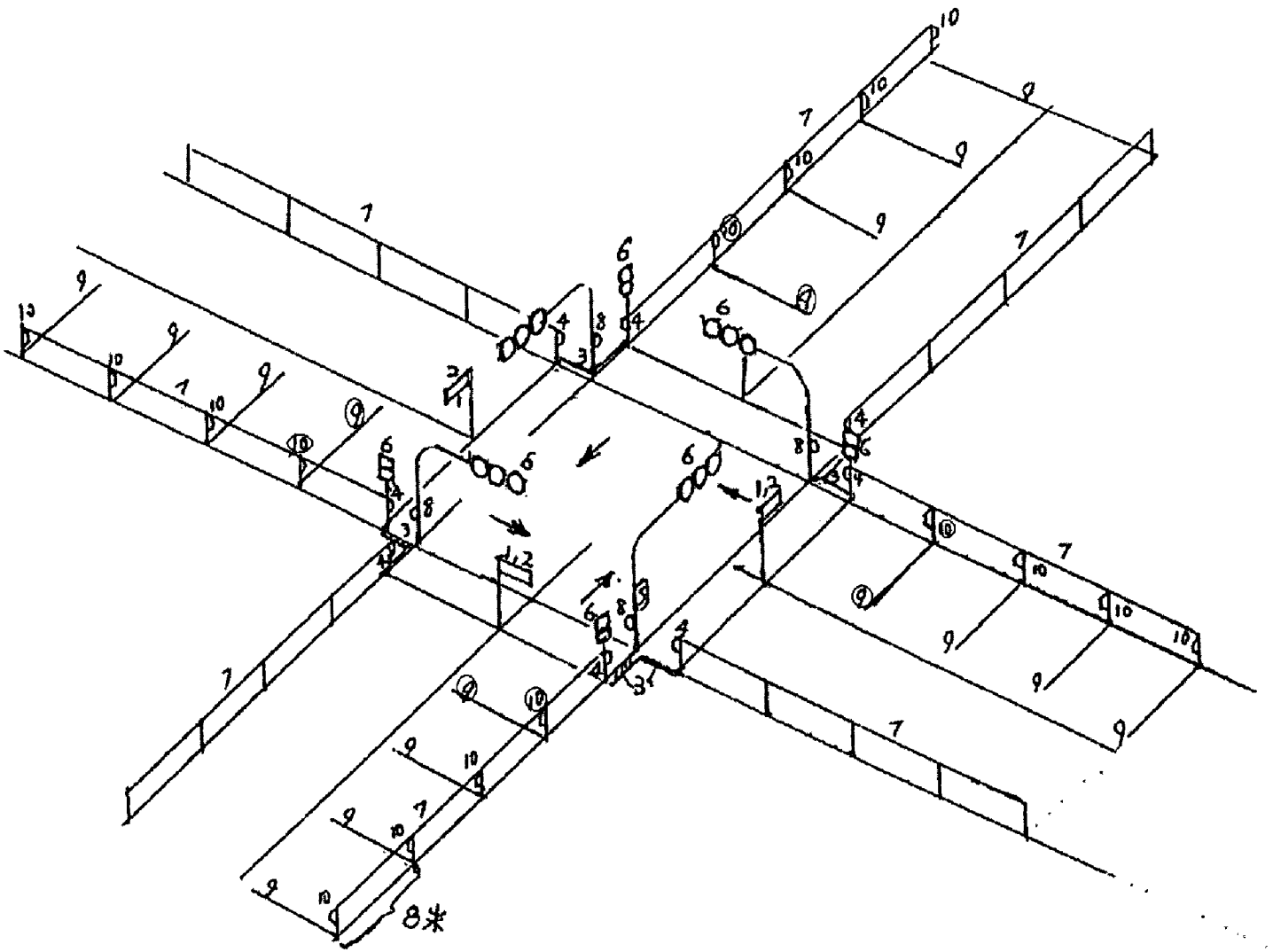
FIG. 4 is a draft for mounting all the apparatus of an apparatus-2-based embodiment of the system for controlling vehicles and walkers to use an intersection.

In FIG. 4:

#1, a 0-3 meter near ultrasonic detector in a Requester of Embodiment 3;

#2, a 4-32 meter far ultrasonic detector in a Requester of Embodiment 3;

#3, a pedal switches in a W-Requester of Embodiment 3;

#4, a button switches in a W-Requester of Embodiment 3;

#5, an Analyzer: intelligent traffic control apparatus;

#6, a Displayer;

#7, fence;

#8, a light detector in a W-Requester of Embodiment 3;

#9, induct coils/weight switches in a Requester of Embodiment 2;

#10, a light detector in a Requester of Embodiment 2;

DETAILED DESCRIPTION OF THE INVENTION WITH THE DRAWINGS AND TABLES

Description of the Preferred Embodiments, Industry Applications

FIG. 4 illustrates an embodiment system mounted for the ratio-extra method for controlling vehicles and walkers of a two-way 4-direction intersection. In the figure,

#1 is a 0-3 meter near-distance ultrasonic detector in a Requester of Embodiment 3 with a 232/422/485 port, which is used for detecting a vehicle within 3 meters in front of stop-line of traffic lights and for transmitting the acquired near-position vehicle as a directional near-request to #5 intelligent traffic control apparatus through port 232/422/485;

#2 is a 4-32 meters far-distance ultrasonic detector in a Requester of Embodiment 3 also with a 232/422/485 port, which is used for detecting a vehicle from 3 meters to 32 meters in front of stop-line of a direction traffic lights and for transmitting the acquired far-position vehicles as a directional far-request to #5 intelligent traffic control apparatus through port 232/422/485;

#3, #4, #8 are respectively pedal switches, button switches, and light sensors for acquiring walker requests, wherein #8 each only detects the #3 position where are waiting-lines and #4 and #3 is a combination option and #4 and #8 is another combination option, which all connect to Or-selection logic with 232/422/485 port further connect to and transmit walker requests to #5 intelligent traffic control apparatus;

#9 is weight-switches/pressure-sensors, alternative option as vehicle near and far detectors that play the same roles as #1 and #2, wherein the circled #9,⑨ each have a controller with two 232/422/485 ports, all #9 in each direction are each separately located 8 meters distance from its adjacent ones and connect to the #⑨ in their own direction through 485 port 1, and the #⑨ use 485 port 2 to connect to #5 that can recognize a vehicle position by the #9s known 8 meters separate distances;

#10 are respectively light sensors, alternative option as vehicle near and far detectors that play the same roles as #1 and #2, wherein the circled #10,⑩ each have a controller with two 232/422/485 ports, all #10 in each direction are each separately located 8 meters distance from its adjacent ones and connect to the #⑩ in their own direction through 485 port 1, and the #⑩ use 485 port 2 to connect to #5 that can recognize a vehicle position by the #10s known 8 meters separate distances;

#6 are traffic lights that connect to the signal driving board of #5 intelligent traffic control apparatus;

#7 is fence for avoiding man-made interference;

#5 is a mini industrial control computer, an intelligent traffic control apparatus with processor, flash memory loaded with said ratio-extra method control logic, port 232/422/485 board "Request Input" connecting to all the sensing/detecting apparatus: #1,#2,#3,#4,#8,#10,#9 by wires, and high-voltage signal driving board "Signal Output" connection to signal displayers: traffic lights by wires.

Figure 3:
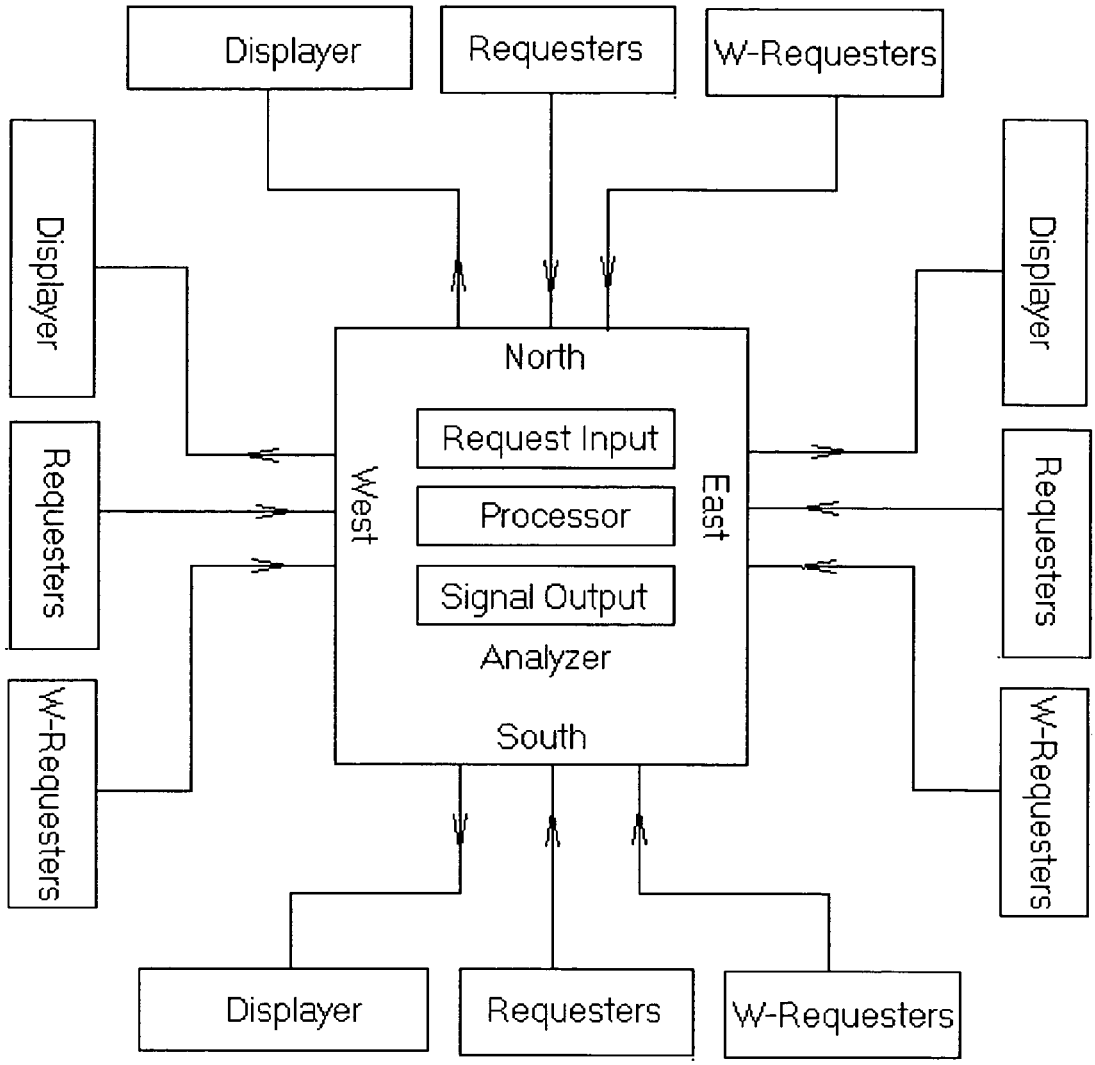
FIG. 3 is a schematic of an apparatus-2-based and a 8051-cored embodiment of the intelligent traffic control apparatus of the system for controlling vehicles and walkers.

FIG. 3 illustrates an intelligent traffic control apparatus implemented on 8051-core technology and ratio-extra method for controlling vehicles and walkers of a two-ways 4-direction intersection. In the figure, "Analyzor" in center is a mini industrial control computer with a mainboard "Processor", two I/O-boards: I/O-board 1 "Request Input", I/O-board 2 "Signal Output". One of alternative options for "Processor" is a microcontroller AT89c52. Inside the "Processor" there are a processor, a flash memory loaded with said ratio-extra method control logic, parallel ports that connect to board "Signal Output", and 1 serial port that connects to board "Request Input". The board "Signal Output" is a high-voltage signal driving board with 24v/220v relays, receives encoded instructions from the parallel ports, decode the instruction by appropriate chips and outputs decoded signals by the relays to control traffic lights "Signal Displayers" in every direction. The board "Request Input" has 232/422/485 convertor and a port 232/422/485 and network-connect to port 485s of all said sensing/detecting apparatus: #1, #2, #3, #4, #8, #10, #9 by wires.

FIG. 1 illustrates a core operating process of the intelligent traffic control apparatus of the embodiment for controlling vehicles and walkers to use an intersection. The process implements a ratio-extra method and includes 8 acts: "start", "time process", "walk-request", "vehicle requests", "walk-process", "extra-method process", "ratio-method process", "recycle". After act "start", the process do recycle from act "time process" to act "recycle" forever.

Figure 2:
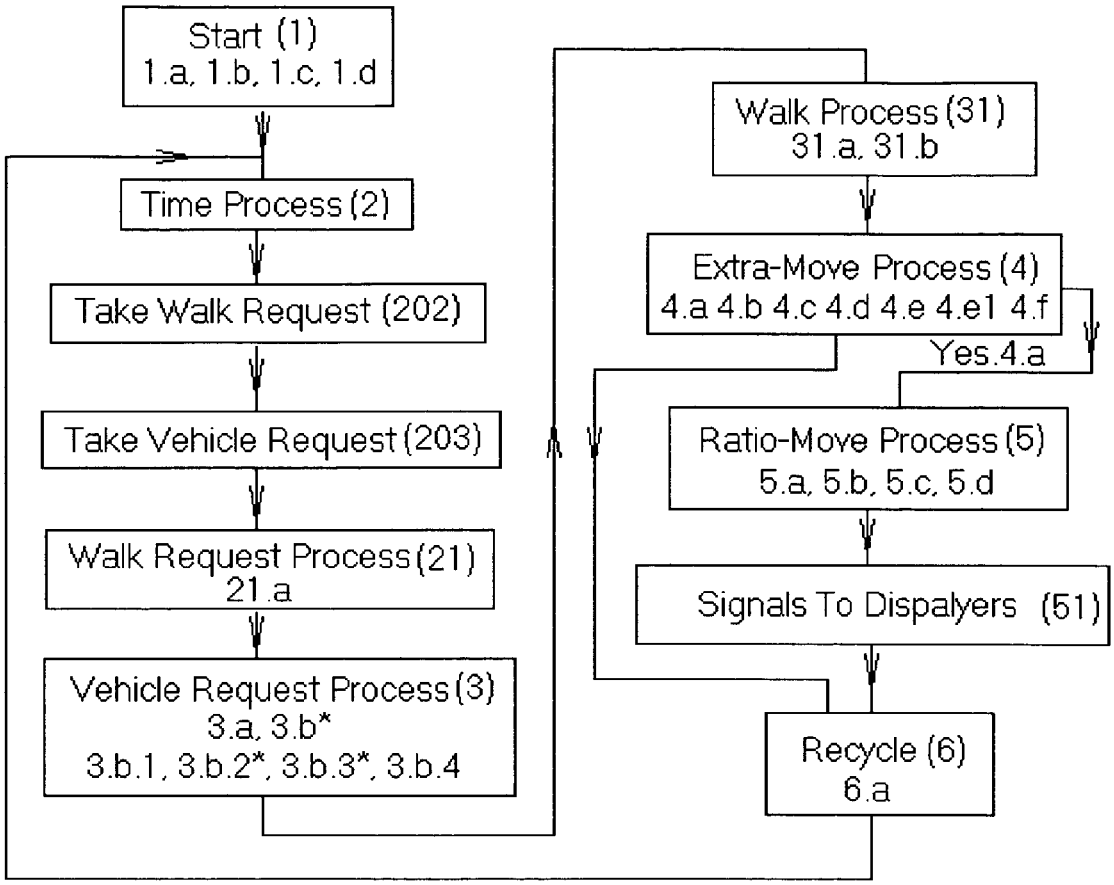
FIG. 2 is a flowchart of one of the method-2-based 8051-based program embodiments of the method for controlling vehicles and walkers to use an intersection.

FIG. 2 illustrates a detail of the operating process with the ratio-extra method of using an intelligent control apparatus for controlling vehicles and walkers to use an intersection with 11 acts including the 8 acts in FIG. 1:

(1) The "Start" sets up necessary parameters listed in TAB.1;

(2) then run the program and the "Time Process"; when one permit updating period is acquired;

(3) then the "Take Walk-Request" fetches acquired walker-requests through transmission ports which connect to walker sensing/detecting apparatus by appropriate means;

(4) then "Take Vehicle-Request" also fetches acquired vehicle-requests through transmission ports which connect to walker sensing/detecting apparatus by appropriate means;

(5) then the "Walk-Request Process" processes acquired walker-requests;

(6) then the "Vehicle-Request Process" processes acquired walker-requests;

(7) then "Walk Process" counts walk permit time down one time unit if a walk permit is granted;

(8) then "Extra Process" counts the extra-method permit time down one time unit then skip over act (9) "Ratio Process" to act (10) "Signals To Displayers" if an extra-method permit is granted;

(9) then "Ratio Process" counts ratio-method permit time down one time unit if a ratio-method permit is granted;

(10) then the "Signals To Displayers" transmits permit signals to all signal displayers by appropriate media;

(11) and then "Recycle" go back to "time process". Wherein:

The act (5) "Walk Request Process" includes acts of:

(a) if a ratio-method permit's Move time is sufficient for walker to cross, grant walk-permits with walk-permit time to walk requests that are not crossing the current vehicle permit directions;

The act (6) "Vehicle Request Process" includes acts of:

(a) if there is neither vehicle-request in a ratio-method permit directions nor walk requests in the other directions, a vehicle request in the other directions is granted an extra-method permit with time of 4 seconds that comes from occupying the ratio-method direction permit time; if the permit time is not sufficient, the offset is subtracted from the permit time of the next ratio-method direction permit time, and the next ratio-method direction becomes a new current ratio-method direction; wherein an extra-watch time needs setting up for the quasi extra-method permit;

(b) keeping the permit for new vehicle requests in the Extra-Direction, or if there is a vehicle request in a non-Extra-Direction and the next Extra-Direction is null, let the non-Extra-Direction be the next Extra-Direction, then giving the direction certain time with the time subtracted from the permit time of the Ratio-Direction; if the permit time is not sufficient, the offset is subtracted from the permit time of the next Ratio-Direction with whose replacing the Ratio-Direction;

The act (8) "Extra Process" includes acts of:

(a) if an extra-method permit is quasi and current extra-watch time is bigger than 0, take off one unit from it, run the last act "recycle"; otherwise, turn the permit into the extra-method permit direction;

(b) if a current extra-method permit time is bigger than 0, subtract one time unit from the time; else if the next extra-method direction is not null, turn the extra-method permit to it, letting the next extra-method direction becomes a new current extra-method direction and the next Extra-Direction null; else turn the permit to the current ratio-method direction entering ratio-method, run step (9);

TAB.2 lists logic rules for changing a ratio-method permit with walk signals when the permit time>0, which includes the acts (5) "Walker Request Process", (6) "Vehicle Request Process", (9) "Ratio Process" of FIG. 2. Wherein rules 4, 6, 9, and 13 in the table change a ratio-method permit into an extra-method permit, for example:

Rule 4 grants an extra-method permit to South/North direction in which direction there are vehicle requests from ratio-method permit direction of East/West in which direction there are no vehicle requests with no walk requests in any direction.

Rule 13 grants an extra-method permit to East/West direction in which direction there are vehicle requests from ratio-method permit direction of South/North in which direction there are no vehicle requests with walk requests.

All other Rules in the table keep in a ratio-method permit with walk permits, for example:

Rule 14 stays in the ratio-method permit direction South/North with granting a walk permit to East/West walk request and without granting a vehicle permit to the East/West vehicle requests.

TAB.3 lists logic rules for changing an extra-method permit with walk signals when the permit time=0, which includes the acts (8) "Extra Process" of FIG. 3. Wherein rules 4, 5, 10, 11, 15, 16, 21 and 22 in the table extend extra-method permit either in time or in direction, for example:

Rule 15 extends the current extra-method permit time in East/West direction in which direction there are vehicle requests without caring walk requests in South/North direction.

Rule 16 extends an extra-method permit to the direction of South/North in which direction there are vehicle requests from the direction of East/West in which direction there are no more vehicle requests without caring walk requests in the direction of East/West.

All other Rules in the table change the extra-method permit into a ratio-method permit with caring walk requests, for example:

Rule 3 change the extra-method permit into a ratio-method permit in the direction of East/West in which direction there are vehicle requests with granting a walk permit to South/North walk requests.

Rule 6 change the extra-method East/West permit into a ratio-method permit in the direction of Shout/North in which direction there are vehicle requests with granting a walk permit to East/West walk requests TAB.4 lists logic rules for changing a ratio-method permit with walk signals when the permit time=0, which includes the acts (5) "Walker Request Process", (6) "Vehicle Request Process", (9) "Ratio Process" of FIG. 2. Wherein rules 3, 7, 10, and 12 in the table change a ratio-method permit into an extra-method permit, for example:

Rule 10 grants an extra-method permit to East/West direction in which direction there are vehicle requests from ratio-method permit direction of East/West without caring walk requests in South/North direction.

All other Rules in the table keep a ratio-method permit direction turn order with granting walk permits, for example:

Rule 14 changes in the ratio-method permit direction from South/North to East/West with granting a walk permit to South/North walk request and without granting a walk permit to the East/West requests.

In summary, one embodiment of the invention is a method of using at least one local intelligent controller for controlling the traffic lights and walk lights in an intersection, ultrasonic detectors for detecting vehicles within 32 meters distance from the intersection in each direction, button switches and light sensors for acquiring waiting walkers at waiting lines in each direction. The 32 meters distance is expected to guarantee for a vehicle just to stop on stop lines in front of an intersection when running at the limit speed of 8 meters per second in a direction. All acquired information from these sensing/detecting apparatus is transmitted to the local intelligent controller. The controller receives these information as directional requests, vehicles' and walkers', and uses a simple and called ratio-extra method to make dispatching decisions: which direction should have green lights and how long the green lights should last. The decision is made every one second. The time that is granted to these dynamic green lights is 4 seconds by which expect to guarantee for a vehicle and only one vehicle to pass the intersection. The ratio-extra method uses as input parameters these directional vehicles' requests, directional walkers' requests, current permit direction with the permit time, and decides conditionally that vehicles arrival to the intersection first use the intersection first safely and maximizedly. In this way, the embodiment of the invention fulfils the general object of the invention: dynamically dispatching permit with minimized permit time among controlled directions based on Riemann Sum Theorem maximizes throughput of intersection traffic.

The inventions set forth above are subject to many changes without departing from the idea, scope or essential characteristics thereof. Thus, the embodiments explained above should be considered in all respect as being illustrative rather than restrictive of the scope of the inventions as defined in the appended claims. For example, the present invention is not limited to the specific embodiments, apparatus or methods disclosed for obtaining traffic information from various traffic information units, for transmitting traffic information, or for determining appropriate action based on the first oncoming vehicles. The present invention is also not limited to the use of ratio-extra methods and the corresponding embodiments, apparatuses and methods disclosed herein. The present invention is also not limited to the use of known sensing/detecting position coordinates to acquire vehicles' and walkers' positions. The present invention is also not limited to any particular form of computer or computer algorithm. Furthermore, the present invention is not limited to the controllers, processors, sensors, signs, transmitter/receivers, antennas, microphone, speaker, camera, display, interface devices, audio/speech devices, and other such devices and components disclosed in this specification.

TABLE 1

Initial Parameter Values Table for Embodiments 1, 2, 3

| No. | Name | Denotation | Unit | Evaluation | Note |
|---|---|---|---|---|---|
| A | Basic Time | TU | Sec. | 1 | |
| B | Limit speed | vs | Meters/sec. | 8 | usually, non-homogenous |
| C | Ratio-Move clean time | RTC | sec | 1 | RTC = roadwidth/vs |
| D | Ratio-Move watch time | RTW | sec. | 4 | |
| E | Extra-Move clean time | ETC | sec. | 0 | ETC = roadwidth/vs |
| F | Extra-Move watch time | ETW | sec. | 2 | ETW relates to vs |
| G | time differential | dt | Sec. | 4 | The appropriate time |
| H | detecting distance for vehicles | vsed | meters | 32 | Vsed = vs * dt<br>The appropriate distance |
| I | detecting-distance for walkers | wsed | meters | 0 | |
| J | walk speed | ws | m/sec. | 1 | Note: option for handicap speed hs = 0.5 |
| K | walk-pass tim | wpt | Sec. | 10 | wpt = roadwidth/ws |
| L | Ratio period | RP | Sec. | 60 | |
| M | Ratio | R | | 0.5 | S/N Time/RP |
| N | Permit-Move | Move | Color | Green | |
| O | Permit-Watch | Watch | Color | Yellow | |
| P | Permit-Clean | Clean | Color | Red | |
| Q | Stop | Stop | color | Red | |

TABLE 1-continued

Initial Parameter Values Table for Embodiments 1, 2, 3

| No. | Name | Denotation | Unit | Evaluation Note |
|---|---|---|---|---|
| R | Default extra-watch time | detw | Sec. | 2 |
| S | extra-watch time | etw | Sec. | 0 |

TABLE 2

True Value Table for Extra-State Permit Change Logic with Walk When Permit Time Runs Out
True Value Table for Ratio-State Permit Change Logic with Walk within Permit Time

| Rule | Permits | | Inputs Requests | | Walk Request | | Output Signals | |
|---|---|---|---|---|---|---|---|---|
| No. | E/W | S/N | E/W | S/N | E/W | S/N | E/W | S/N |
| 1 | 1 | 0 | 0 | 0 | x | (Y) | 1 | 0 |
| 2 | 0 | 1 | 0 | 0 | (X) | Y | 0 | 1 |
| 3 | 1 | 0 | 1 | 0 | X | (Y) | 1 | 0 |
| 4 | 1 | 0 | 0 | 1 | 0 | 0 | 0(-dt) | +1 |
| 5 | 1 | 0 | 1 | 1 | X | (Y) | 1 | 0 |
| 6 | 0 | 1 | 1 | 0 | 0 | 0 | +1 | 0(-dt) |
| 7 | 0 | 1 | 0 | 1 | (X) | Y | 0 | 1 |
| 8 | 0 | 1 | 1 | 1 | (X) | Y | 0 | |
| 9 | 1 | 0 | 0 | 1 | 1 | 0 | 0(-dt) | +1 |
| 10 | 1 | 0 | 0 | 1 | 0 | (1) | 1 | 0 |
| 11 | 1 | 0 | 0 | 1 | 1 | (1) | 1 | 0 |
| 12 | 0 | 1 | 1 | 0 | (1) | 0 | 0 | 1 |

TABLE 2-continued

True Value Table for Extra-State Permit Change Logic with Walk When Permit Time Runs Out
True Value Table for Ratio-State Permit Change Logic with Walk within Permit Time

| Rule | Permits | | Inputs Requests | | Walk Request | | Output Signals | |
|---|---|---|---|---|---|---|---|---|
| No. | E/W | S/N | E/W | S/N | E/W | S/N | E/W | S/N |
| 13 | 0 | 1 | 1 | 0 | 0 | 1 | +1 | 0(-dt) |
| 14 | 0 | 1 | 1 | 0 | (1) | 1 | 0 | 1 |

Note:
1) "Ratio-state" in the title means that a current permit is a ratio-method permit.
2) "E/W" means East and/or West, "S/N" means South and/or North.
3) "Permit = 1" means a ratio permit signal, "Permit = 0" means stop signal, "Permit = +1" means an extra permit signal.
4) "Request = 1" means requesting, "Request = 0" means no requests.
5) "E/W Output Signals = 1" means that East and/or West signals are permit and that South and/or North Output Signals are stops.
6) "x", "y", "z" = 1 or 0, "−x" or 1
7) Walk Request value "(X)" means that the walk request will be permitted if X = 1.
8) "(-dt)" means that the time in the ratio-method direction is occupied by quantity of an extra-method permit time dt, dt = 4sec. for here; and e.g. in rule 4 (-dt) occurs the ratio method direction E/W.
9) The time of the next ratio-method direction will be occupied when current ratio-method time is insufficient for dt.

TABLE 3

True Value Table for Extra-State Permit Change Logic with Walk When Permit Time = 0

| Rule | Permits | | Requests | | Inputs Walk Request | | Ratio-Direction | | Output Signals | |
|---|---|---|---|---|---|---|---|---|---|---|
| No. | E/W | S/N | E/W | S/N | E/W | S/N | E/W | S/N | E/W | S/N |
| 1 | +1 | 0 | 0 | 0 | Z | Y | X | −x | x | −x |
| 2 | 0 | +1 | 0 | 0 | Z | Y | X | −x | x | −x |
| 3 | +1 | 0 | 1 | 0 | Z | (Y) | 1 | 0 | 1 | 0 |
| 4 | +1 | 1 | 0 | 0 | 0 | 0 | 1 | +1 | 0(-dt) | |
| 5 | +1 | 0 | 0 | 1 | 0 | 0 | 1 | 0 | 0(-dt) | +1 |
| 6 | +1 | 0 | 0 | 1 | (Z) | Y | 0 | 1 | 0 | 1 |
| 7 | +1 | 0 | 1 | 1 | Z | (Y) | 1 | 0 | 1 | 0 |
| 8 | +1 | 0 | 1 | 1 | (Z) | Y | 0 | 1 | 0 | 1 |
| 9 | 0 | +1 | 1 | 0 | Z | (Y) | 1 | 0 | 1 | 0 |
| 10 | 0 | +1 | 1 | 0 | 0 | 0 | 0 | 1 | +1 | 0(-dt) |
| 11 | 0 | +1 | 0 | 1 | 0 | 0 | 1 | 0 | 0(-dt) | +1 |
| 12 | 0 | +1 | 0 | 1 | (Z) | Y | 0 | 1 | 0 | 1 |
| 13 | 0 | +1 | 1 | 1 | Z | (Y) | 1 | 0 | 1 | 0 |
| 14 | 0 | +1 | 1 | (Z) | Y | 0 | 1 | 0 | 1 | |
| 15 | +1 | 0 | 1 | 0 | 0 | 1 | 0 | 1 | +1 | 0(-dt) |
| 16 | +1 | 0 | 0 | 1 | 1 | 0 | 1 | 0 | 0(-dt) | +1 |
| 17 | +1 | 0 | 1 | 0 | 1 | 0 | 0 | 1 | 1 | 0 |
| 18 | +1 | 0 | 0 | 1 | 0 | 1 | 1 | 0 | 0 | 1 |
| 19 | +1 | 0 | 1 | 0 | 1 | (1) | 0 | 1 | 1 | 0 |

TABLE 3-continued

True Value Table for Extra-State Permit Change Logic with Walk When Permit Time = 0

| Rule | Inputs: Permits | | Requests | | Walk Request | | Ratio-Direction | | Output Signals | |
|---|---|---|---|---|---|---|---|---|---|---|
| No. | E/W | S/N | E/W | S/N | E/W | S/N | E/W | S/N | E/W | S/N |
| 20 | +1 | 0 | 0 | 1 | (1) | 1 | 1 | 0 | 0 | 1 |
| 21 | 0 | +1 | 1 | 0 | 0 | 1 | 0 | 1 | +1 | 0(-dt) |
| 22 | 0 | +1 | 1 | 1 | 0 | 1 | 0 | 0(-dt) | +1 | |
| 23 | 0 | +1 | 1 | 0 | 1 | 0 | 0 | 1 | 1 | 0 |
| 24 | 0 | +1 | 0 | 1 | 0 | 1 | 1 | 0 | 0 | 1 |
| 25 | 0 | +1 | 1 | 0 | 1 | (1) | 0 | 1 | 1 | 0 |
| 26 | 0 | +1 | 0 | 1 | (1) | 1 | 1 | 0 | 0 | 1 |

Note:
1) "Extra-state" in the title means that a current permit is an extra-method permit.
2) "E/W" means East and/or West, "S/N" means South and/or North.
3) "Permit = 1" means a ratio permit signal, "Permit = 0" means stop signal, "Permit = 1" means an extra permit signal.
4) "Request = 1" means requesting, "Request = 0" means no requests.
5) "(E/W = Ratio-Direction) = 1" means that the current ration-method direction is East and/or West.
6) "x","y", "z"= 1 or 0, "-x" = or 1.
7) Walk Request value "(Y)" mean the walk requests to be permitted if Y = 1.
8) "E/W Output Signals = 1" means that East and/or West signals are permit, that South and/or North stop.
9) "(-dt)" means that the time in the ratio-method direction is occupied by quantity of an extra-method permit time dt, dt = 4sec. for here; and e.g. in rule 4 (-dt) occurs the ratio method direction S/N.

TABLE 4

True Value Table for Ratio-State Permit Change Logic with Walk When Permit Time = 0
True Value Table for Ratio-State Permit Change Logic with Walk When Permit Time Runs Out

| Rule | Inputs: Permits | | Requests | | Walk Requests | | Output Signals | |
|---|---|---|---|---|---|---|---|---|
| No. | E/W | S/N | E/W | S/N | E/W | S/N | E/W | S/N |
| 1 | 1 | 0 | 0 | 0 | (X) | Y | 0 | 1 |
| 2 | 0 | 1 | 0 | 0 | X | (Y) | 1 | 0 |
| 3 | 1 | 0 | 1 | 0 | 0 | 0 | +1 | 0(-dt) |
| 4 | 1 | 0 | 0 | 1 | (X) | X | 0 | 1 |
| 5 | 1 | 0 | 1 | 1 | (X) | Y | 0 | 1 |
| 6 | 0 | 1 | 1 | 0 | X | (Y) | 1 | 0 |
| 7 | 0 | 1 | 0 | 1 | 0 | 0 | 0(-dt) | +1 |
| 8 | 0 | 1 | 1 | 1 | X | (Y) | 1 | 0 |
| 9 | 1 | 0 | 1 | 0 | (1) | 0 | 0 | 1 |
| 10 | 1 | 0 | 1 | 0 | 0 | 1 | +1 | 0(-dt) |
| 11 | 1 | 0 | 1 | 0 | (1) | 1 | 0 | 1 |
| 12 | 0 | 1 | 0 | 1 | 1 | 0 | 0(-dt) | +1 |
| 13 | 0 | 1 | 0 | 1 | 0 | (1) | 1 | 0 |
| 14 | 0 | 1 | 0 | 1 | 1 | (1) | 1 | 0 |

Note:
1) "Ratio-state" in the title means that a current permit is a ratio-method permit.
2) "E/W" means East and/or West, "S/N" means South and/or North.
3) "Permit = 1" means a ratio permit signal, "Permit = 0" means stop signal, "Permit + 1" means an extra permit signal.
4) "Request = 1" means requesting, "Request = 0" means no requests.
5) "E/W Output Signals = 1" means that East and/or West signals are permit and that South and/or North Output Signals are stops.
6) "x", "y", "z" = 1 or 0, "−x" = 0 or 1.
7) Walk Request value "(X)" means that the walk requests will be permitted if X = 1.
8) "(-dt)" means that the time in the ratio-method direction is occupied by quantity of an extra-method permit time dt, dt=4sec. for here; and e.g. in rule 3 (-dt) occurs the ratio method direction S/N.

What is claimed as new and desired to be protected by Letters Patent is set forth in the following:

1. A method of controlling traffic at an intersection, comprising the steps of:

controlling traffic at the intersection initially by an adjustable ratio move technique;

determining the direction of a first vehicle at a predetermined distance from the intersection by providing a first vehicle permit in a first direction to the first vehicle to allow the vehicle to pass through the intersection;

determining the a motion parameter of the first vehicle from the intersection;

transmitting the motion parameters including the distance to a controller;

extending the first vehicle permit based on motion parameters of the first vehicle.

2. A method of controlling traffic at an intersection as in claim 1, wherein the method includes the step of ending the first permit to the first vehicle and providing a second vehicle permit in a second direction to a second vehicle to allow the second vehicle to pass to the intersection based upon the motion parameters obtained from the first vehicle.

3. A method of controlling traffic at an intersection as in claim 1, wherein the first vehicle permit includes move time.

4. A method of controlling traffic at an intersection as in claim 1, wherein the first vehicle permit includes watch time.

5. A method of controlling traffic at an intersection as in claim 1, wherein the first vehicle permit includes clean time.

6. A method of controlling traffic at an intersection as in claim 1, wherein the method includes the step of calculating a walker permit based upon the first vehicle permit.

7. A method of controlling traffic at an intersection as in claim 1, wherein the method includes the step of extending the first vehicle permit when no vehicle is detected from the second direction.

8. A method of controlling traffic at an intersection as in claim 1, wherein the motion parameter includes including the distance to the first vehicle.

9. A method of controlling traffic including vehicle traffic and walker traffic at an intersection, comprising the steps of:

controlling traffic at the intersection initially by an adjustable ratio move technique;

obtaining a motion parameter of a first vehicle traveling in a first direction approaching the intersection;

determining the direction of a first vehicle at a predetermined distance from the intersection by providing a first vehicle permit in a first direction to the first vehicle to allow the vehicle to pass through the intersection;

obtaining a walker request in a second direction for the walker traffic to cross the intersection;

transmitting the motion parameter of the first vehicle to a controller;

transmitting the walker request of the walker traffic to the controller;

determining if the first vehicle permit is to be extended based upon the motion parameter of the first vehicle;

obtaining a walker permit based upon whether or not the first vehicle permit is extended.

10. A method of controlling traffic including vehicle traffic and walker traffic at an intersection as in claim 9, wherein the walker permit is displayed to the walker traffic.

11. A method of controlling traffic including vehicle traffic and walker traffic at an intersection as in claim 9, wherein the first vehicle permit is displayed to the first vehicle.

12. A system of controlling traffic at an intersection, comprising:

a controller for controlling traffic at the intersection initially by an adjustable ratio move technique;

a detection device for determining the direction of a first vehicle at a predetermined distance from the intersection by providing a first vehicle permit in a first direction to the first vehicle to allow the vehicle to pass through the intersection;

the detection device determining the a motion parameter of the first vehicle from the intersection;

the detection device transmitting the motion parameters including the distance to a controller;

the controller extending the first vehicle permit based on motion parameters of the first vehicle.

13. A system of controlling traffic at an intersection as in claim 12, wherein the controller ends the first permit to the first vehicle and provides a second vehicle permit in a second direction to a second vehicle to allow the second vehicle to pass to the intersection based upon the motion parameters obtained from the first vehicle.

14. A system of controlling traffic at an intersection as in claim 12, wherein the first vehicle permit includes move time.

15. A system of controlling traffic at an intersection as in claim 12, wherein the first vehicle permit includes watch time.

16. A system of controlling traffic at an intersection as in claim 12, wherein the first vehicle permit includes clean time.

17. A system of controlling traffic at an intersection as in claim 12, wherein the controller calculates a walker permit based upon the first vehicle permit.

18. A system of controlling traffic at an intersection as in claim 12, wherein the controller extends the first vehicle permit when no vehicle is detected from the second direction.

19. A system of controlling traffic at an intersection as in claim 12, wherein the motion parameter includes including the distance to the first vehicle.

* * * * *